United States Patent [19]

Damon, Sr.

[11] 4,134,187

[45] Jan. 16, 1979

[54] PILE FABRIC CRUSHING APPARATUS

[75] Inventor: John F. Damon, Sr., Warwick, R.I.

[73] Assignee: Joan Fabrics Corporation, Lowell, Mass.

[21] Appl. No.: 864,661

[22] Filed: Dec. 27, 1977

[51] Int. Cl.[2] ..... D06C 23/04; D06J 1/02

[52] U.S. Cl. ..... 26/2 R; 223/30; 264/282

[58] Field of Search ..... 26/69 R, 1, 2 R; 223/28, 30, 31; 162/280, 111; 156/183, 474; 264/282

[56] References Cited

U.S. PATENT DOCUMENTS

| | | | |
|---|---|---|---|
| 2,289,290 | 7/1942 | Maxant | 223/30 |
| 2,318,497 | 5/1943 | Kassel | 223/30 X |
| 3,562,064 | 2/1971 | Rost et al. | 156/474 |
| 3,987,519 | 10/1976 | Potosnak et al. | 26/1 X |

OTHER PUBLICATIONS

PCR-180 Polrotor Crusher, Polrotor Inc., Amityville, N.Y.

*Primary Examiner*—Robert Mackey

*Attorney, Agent, or Firm*—Bell, Seltzer Park & Gibson

[57] ABSTRACT

Improved apparatus is provided for crushing cloth, such as velvet or other pile type fabric, by continuously forcing lengths of the cloth into an elongated treatment chamber to form random creases therein. The cloth is stuffed into the treatment chamber by a bank of individual pusher feet which are reciprocated back and forth adjacent the entrance end of the treatment chamber. The pusher feet are moved downwardly into resilient driving engagement with the cloth during each forward movement and are lifted out of driving engagement with the cloth during each rearward movement by a cam and control lever. A cloth retaining gate or comb is provided on the entrance end of the treatment chamber to aid in retaining the crushed cloth in the entrance end of the treatment chamber.

7 Claims, 4 Drawing Figures

10
70a
70b
20
70
62
63
25
26
23
24
30
35
12
16
42
45
41
55
46
43
44
50
51
54
53
52
57
56
60
37
36
40
C
31
32
34
15
33
14
13

PILE FABRIC CRUSHING APPARATUS

This invention relates generally to an improved cloth crushing apparatus and more particularly to such an apparatus which employs a bank of individual pusher feet supported for back-and-forth reciprocation at the entrance end of an enlongated treatment chamber for continuously stuffing lengths of the cloth into the treatment chamber to form random creases therein.

It is generally known to form random creases in cloth to provide a crushed appearance thereto. In some cases, this appearance has been obtained by longitudinally compressing a wadded mass of the cloth in an elongated treatment chamber and heat-setting the creases in the cloth. One such apparatus currently available is the PCR-180 Polrotor crusher sold by Polrotor, Inc. of Amityville, N.Y. This crusher employs a bank of reciprocated pusher feet to stuff successive lengths of cloth into an elongate treatment chamber where the creases are heat-set in the cloth. However, this known type of apparatus has a limited operational speed and the cloth is not fed into the treatment chamber in a positive and uniform manner and the creased cloth is not retained in the entrance end of the treatment chamber in a positive manner. In certain instances positive and uniform feeding or stuffing does not take place because the vertical position of the pusher feet is controlled by an air cylinder which may be operated out of the proper timed sequence with the horizontal movement of the pusher feet so that lifting and lowering of the pusher feet does not occur at the proper time. Positive and uniform stuffing of the cloth may not take place in this known type of apparatus because the open entrance end of the treatment chamber is not provided with means to retain the wadded cloth therein.

With the foregoing in mind, it is an object of the present invention to provide a cloth crushing apparatus which crushes cloth at a high rate of speed, feeds the cloth into the treatment chamber in a positive and uniform manner and retains the crushed and wadded cloth in the entrance opening of the treatment chamber.

In accordance with the present invention, pusher means, in the form of a bank of pusher feet, is supported for forward and rearward movement adjacent the entrance end of the treatment chamber and the pusher feet are resiliently maintained in engagement with the cloth during each forward movement of the pusher feet so that the cloth is fed into the treatment chamber in a positive and uniform manner. Cam control means is operatively associated with the pusher feet for lowering the pusher feet into driving engagement with the cloth at the proper time during each forward movement and for lifting the pusher feet out of driving engagement with the cloth at the proper time during each rearward movement. The bank of spaced-apart pusher feet extends transversely of the opening at the entrance end of the treatment chamber and gate or comb means is supported on the entrance opening of the treatment chamber and extends downwardly and between the pusher feet for aiding in retaining the crushed cloth in the entrance end of the treatment chamber.

Other objects and advantages will appear as the description proceeds when taken in connection with the accompanying drawings, in which —

Figure 1:
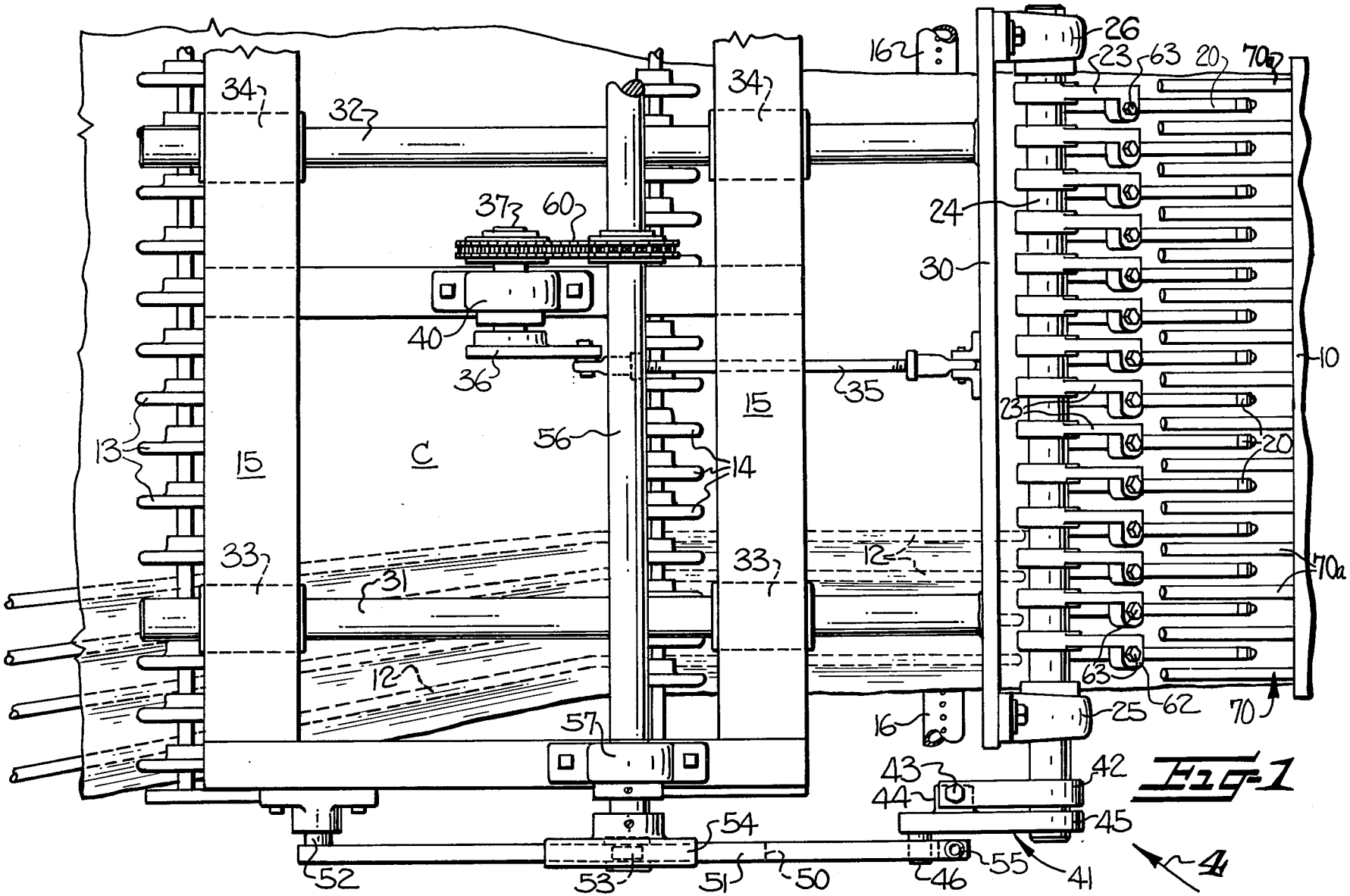
FIG. 1 is a fragmentary plan view of the cloth crushing apparatus of the present invention.
Figure 2:
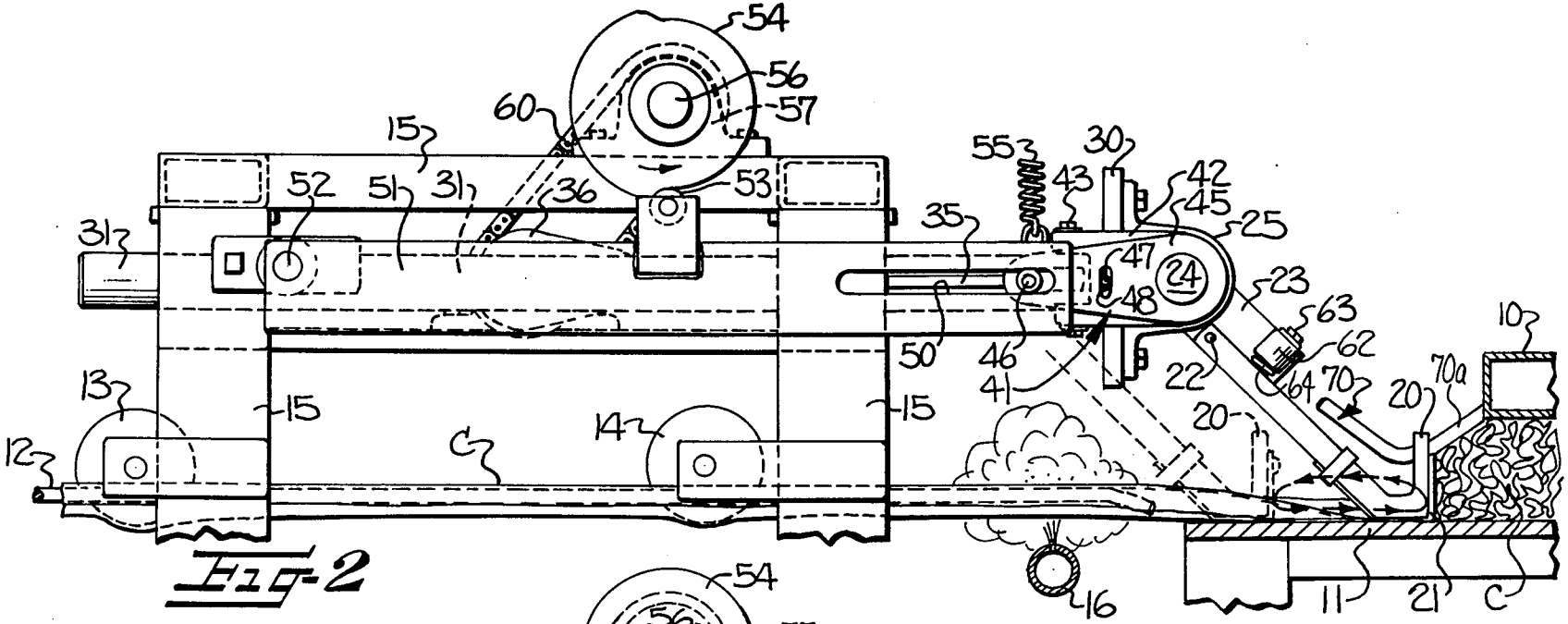
FIG. 2 is a fragmentary side elevational view of the apparatus of FIG. 1 with the entrance end of the treatment chamber being shown in cross-section.
Figure 3:
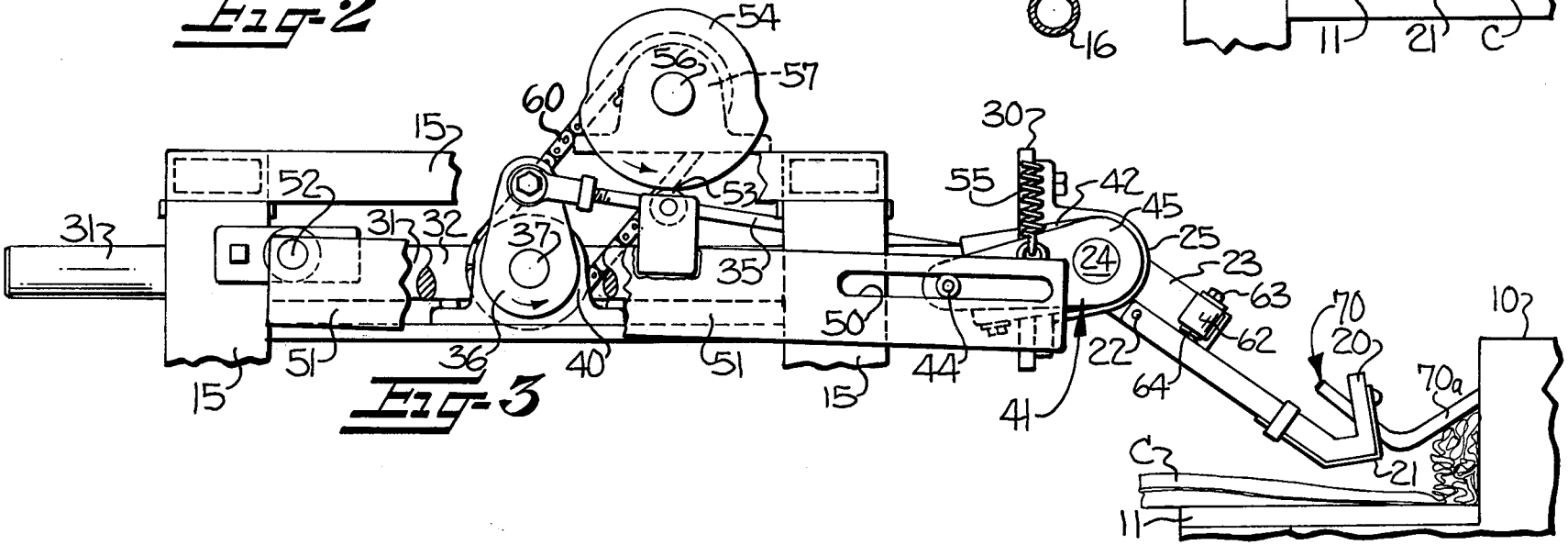
FIG. 3 is a view similar to FIG. 2 but illustrating the pusher feet in lifted position as they move in a rearward direction.

As illustrated in FIGS. 1–3, the cloth C is withdrawn from a suitable supply, not shown, and is fed into the opening defining the entrance end of an elongated treatment chamber, illustrated as a heated setting box 10. Suitable guide plate means, in the form of a support plate 11 (FIG. 2), extends through and outwardly from the lower portion of the opening at the entrance end of the treatment chamber for directing the cloth into the treatment chamber 10. The treatment chamber 10 may be of any desired length and is provided with an exit end, not shown, through which the crushed cloth is withdrawn. Suitable guide elements are provided to fold and pleat the cloth C in a longitudinal direction as the cloth moves toward the entrance end of the treatment chamber 10. The guide elements are illustrated as comprising a plurality of converging support rods 12 with sets of wheels or rollers 13, 14 supported between the guide rods 12 for moving the cloth downwardly therebetween and for pleating or folding the cloth in the longitudinal direction. The rods 12 and wheels 13, 14 are suitably supported on the frame 15 and a steam pipe 16 is provided for steaming the cloth before it moves into the treatment chamber 10, as illustrated in FIG. 2.

Figure 4:
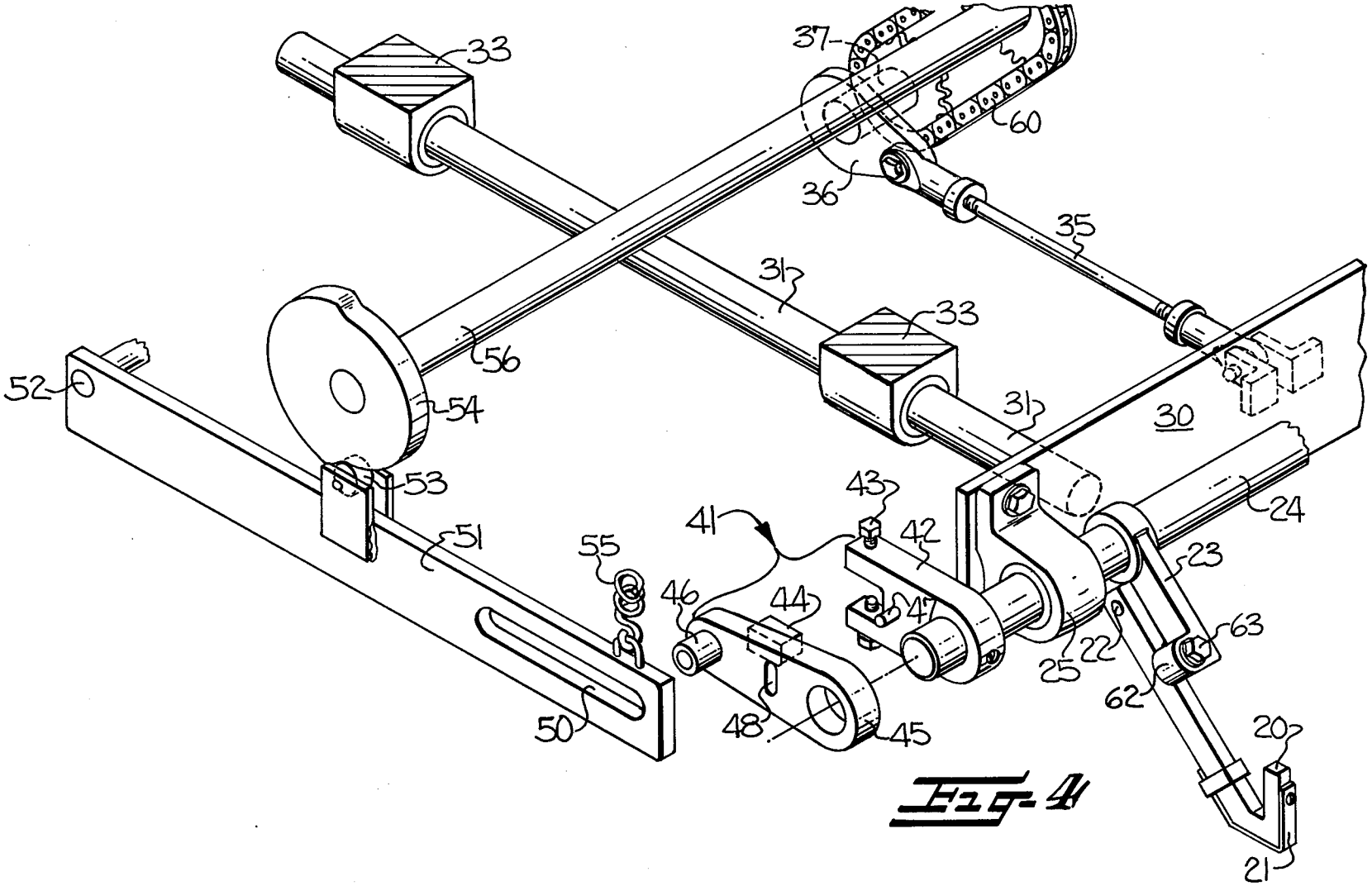
FIG. 4 is a fragmentary isometric view looking in substantially the direction of the arrow 4 in FIG. 1 and with parts exploded for purposes of clarity.

Pusher means is supported on the frame 15 for forward and rearward movement adjacent the entrance end of the treatment chamber 10. As best illustrated in FIG. 1, the pusher means includes a plurality or bank of spaced-apart pusher feet 20 having lower free ends provided with suitable friction material, such as belting strips 21 (FIG. 4) suitably attached thereto. The upper end portions of the pusher feet 20 are pivotally supported, as at 22, on one side of pusher operating arms 23, the upper ends of which are fixed on a pusher operator shaft 24. Opposite end portions of the pusher operator shaft 24 are supported in bearings 25, 26 (FIG. 1) which are in turn fixed on a pusher mounting plate 30. The pusher mounting plate 30 is fixed adjacent opposite ends on the forward ends of linear shafts 31, 32 which are supported for sliding movement in respective pairs of linear bearings 33, 34, supported on the frame 15.

The pusher feet 20 are reciprocated back and forth for forward and rearward movement by means of an actuating link 35, the forward end of which is suitably secured to the pusher mounting plate 30 and the rearward end of which is attached to the free end of an eccentric lever 36 fixed on a drive shaft 37. The drive shaft 37 is suitably supported for rotation in a bearing 40 fixed on the frame 15. The shaft 37 is rotated in a manner to be presently described. With continued rotation of the shaft 37, the pusher mounting plate 30 is continuously reciprocated forwardly and rearwardly so that the pusher feet 20 continuously stuff lengths of the cloth into the treatment chamber 10 with each forward movement and in a manner to be presently described.

Cam control means is operatively associated with the pusher means for moving the pusher feet 20 downwardly into driving engagement with the upper surface of the cloth as it passes over the support plate 11 during each forward movement of the pusher feet 20. The cam control means also lifts the pusher feet 20 out of driving engagement with the upper surface of the cloth during each rearward movement of the pusher feet 20. The cam control means operates in positive timed relationship to the forward and rearward movements of the pusher feet 20 and includes a first cam lever, broadly indicated at 41, with one end fixed on the pusher operator shaft 24. The first cam lever 41 (FIG. 4) is adjustable and is formed of two parts, including an adjustment arm 42 fixed at one end on shaft 24 and having a bifurcated free end with adjustment screws 43 threadably supported therein. The inner ends of the adjustment screws 43 are adapted to engage opposite sides of an adjustment abutment 44 fixed on one side of an adjustment lever 45, forming the other part of the first cam lever 41. One end of the adjustment lever 45 surrounds the pusher operator shaft 24 and the other or free end is provided with a cam follower 46. A guide pin 47 is fixed at one end in one side of the adjustment arm 42 and a guide slot 48 is provided in the adjustment lever 45 for reception of the guide pin 47.

The cam follower 46 is adapted to ride in an elongate cam slot 50 provided in the forward end of a second cam lever 51. The rear end of the second cam lever 51 is supported for pivoting movement on a support pin 52 which is fixed in the frame 15. The medial portion of the cam lever 51 is provided with a cam roller 53 (FIG. 4) which is maintained in resilient engagement with an operating cam 54 by means of a tension spring 55. The operating cam 54 is fixed on one end of a shaft 56 which is supported for rotation in bearings 57, only one of which is shown, on opposite sides of the frame 15 and the shaft 56 is driven in a continuous manner by any suitable means, such as a motor, not shown. The shaft 37 is driven from the shaft 56 by means of sprockets and a drive chain 60, as illustrated in FIG. 1.

As reciprocation is imparted to the pusher mounting plate 30 and the pusher operator shaft 24, the cam follower 46 is reciprocated back and fourth in the cam slot 50 in the second cam lever 51. As illustrated in FIG. 2, the cam roller 53 rides on a low portion of the cam 54 during forward movement of the pusher feet 20. When the pusher feet 20 are moved rearwardly, the cam roller 53 is engaged by a higher portion of the cam 54, as illustrated in FIG. 3, so that the forward end of the second cam lever 51 is moved downwardly to rock the pusher operator shaft 24 in a counterclockwise direction and lift the pusher feet 20 out of driving engagement with the cloth during each rearward movement. At the end of the rearward stroke, the cam roller 53 moves into a low portion of the cam 54 so that the forward end of the second cam lever 51 is raised by the spring 55 and the pusher operator shaft 24 is rocked in a clockwise direction so that the lower ends of the pusher feet 20 engage the upper surface of the cloth positioned on the support plate 11 and the pusher feet 20 remain in driving engagement with the cloth during the entire forward stroke, as illustrated in FIG. 2. The screws 43 in the adjustment arm 42 of the first cam lever permit rotational adjustment of the pusher operator shaft 24 relative to the second cam lever 51 and cam 54.

The apparatus is provided with conventional resilient means operatively interposed between the pusher operator shaft 24 and the individual pusher feet 20 to permit individual and resilient vertical adjustment between adjacent pusher feet in relationship to the number of layers of the cloth which might be positioned therebeneath as the longitudinally pleated and folded cloth is pushed along the support plate 11 during each forward movement of the pusher feet. To this end, the operating arm 23 is provided with an integrally formed boss 62 (FIG. 4) in which an adjustment screw 63 is supported with the lower end being threadably embedded in the medial portion of the upwardly extending portion of the pusher foot 20. A compression spring 64 (FIGS. 2 and 3) surrounds the adjustment screw 63 and is retained in a bore in the boss 62. During each forward stroke of the pusher feet 20, the spring 55 applies downward pressure on the pusher feet 20 against the upper surface of the cloth in a uniform manner. However, if two or more layers of the longitudinally pleated and folded cloth are positioned beneath a particular pusher foot 20, the spring 64 permits this pusher foot to remain at a higher level than adjacent pusher feet which may be engaging only a single unfolded layer of cloth.

In accordance with the present invention, gate or comb means, broadly indicated at 70, is supported on the entrance end of the treatment chamber 10 and extends downwardly and between the pusher feet 20 for aiding in retaining the stuffed cloth in the entrance end of the treatment chamber. Although the pusher feet 20 are lifted during rearward movement, the stuffed cloth has a tendency to back out of the entrance end of the treatment chamber, unless restrained. The gate or comb means 70 is illustrated in FIGS. 1–3 as including spaced-apart downwardly extending finger elements or rods 70*a* having their forward ends fixed to the top of the entrance end of the treatment chamber and extending downwardly therefrom to form an upwardly diverging area adjacent the upper portion of the entrance opening of the treatment chamber 10. The finger elements 70*a* are spaced above the guide plate 11 and include curved medial portions positioned between each of the pusher feet 20 and free rearward ends. A rod 70*a* is positioned on each side of each pusher foot 20 and aids in preventing rearward movement of the cloth stuffed into the treatment chamber 10.

The cloth crushing apparatus of the present invention thus provides positive and uniform feeding of the cloth into the treatment chamber by the use of cam control means for accurately timing the raising and lowering of the pusher feet. Also, the gate or comb means aids in preventing rearward movement of the cloth in the opening defining the entrance end of the treatment chamber.

In the drawings and specification there has been set forth a preferred embodiment of the invention, and although specific terms are employed, they are used in a generic and descriptive sense only and not for purposes of limitation, the scope of the invention being defined in the claims.

I claim:

1. In an apparatus for the continuous crushing of cloth, such as velvet or other pile type fabric, by the formation of random creases including an elongated treatment chamber having an entrance defining an entrance opening and in which treatment chamber the crushed cloth accumulates, guide plate means extending outwardly from the bottom of said entrance opening of said treatment chamber for directing the cloth into said treatment chamber, a plurality of pusher feet supported for forward and rearward movement along said guide plate means and extending transversely and in spaced-apart relationship adjacent the entrance end of said treatment chamber, said pusher feet being engageable with the cloth for moving the cloth along said guide plate means to successively stuff the cloth through said treatment chamber with each forward movement thereof, the combination therewith of (a) cam control means operatively associated with said pusher feet for moving said pusher feet into driving engagement with the cloth supported on said guide plate means during each forward movement of said pusher feet and for lifting said pusher feet out of driving engagement with the cloth during each rearward movement of said pusher feet, and (b) gate means supported on the entrance end of said treatment chamber and extending partially across said entrance opening for permitting stuffing of the cloth into said treatment chamber while aiding in preventing withdrawal of the cloth from said treatment chamber upon rearward movement of said pusher feet, said gate means comprising individual spaced-apart finger elements including forward ends fixed to the top of said entrance opening and extending downwardly therefrom to form an upwardly diverging area adjacent the upper portion of said entrance opening, said finger elements being spaced above said guide plate means and including curved medial portions positioned between each of said pusher feet and free rearward ends.

2. An apparatus according to claim 1 wherein said cam control means includes cam wheel means operating in timed relationship to the forward and rearward movements of said pusher feet, and control lever means operated by said cam wheel means and operatively connected to said pusher feet for lifting said pusher feet out of driving engagement with the cloth during each rearward movement and for lowering said pusher feet into stuffing engagement with the cloth during each forward movement.

3. An apparatus according to claim 2 including an operator shaft extending transversely of said treatment chamber and supporting said pusher feet thereon, and wherein said control lever means includes a first cam lever fixed at one end to said operator shaft and having a free end spaced from said operator shaft, and a second cam lever pivotally supported at one end and having a medial portion engaged by said cam means to raise and lower the opposite end of said second cam lever, the free end of said first cam lever being operatively connected to said other end of said second cam lever so that said operator shaft is rocked at the end of each forward and rearward movement of said pusher feet supported thereby.

4. An apparatus according to claim 3 wherein the end of said second cam lever remote from said pivoted end includes a slotted cam track, and wherein said free end of said first cam lever includes a cam follower positioned in said slotted cam track of said second cam lever.

5. An apparatus according to claim 4 wherein said first cam lever includes adjustment means for changing the position of said cam follower relative to said operator shaft to permit adjustment of the vertical position of said pusher feet during forward and rearward movements thereof.

6. In an apparatus for the continuous crushing of cloth, such as velvet or other pile type fabric, by the formation of random creases including an elongated treatment chamber having an entrance defining an entrance opening and in which treatment chamber the crushed cloth accumulates, guide plate means extending outwardly from the bottom of said entrance opening of said treatment chamber for directing the cloth into said treatment chamber, pusher means supported for forward and rearward movement along said guide plate means and adjacent the entrance end of said treatment chamber, said pusher means being engageable with the cloth for moving the cloth along said guide plate means to successively stuff the cloth through said treatment chamber with each forward movement thereof, the combination therewith of cam control means operatively associated with said pusher means for moving said pusher means into driving engagement with the cloth supported on said guide plate means in timed relation with each forward movement of said pusher means and for lifting said pusher means out of driving engagement with the cloth supported on said guide plate means in timed relation with each rearward movement of said pusher means, said cam control means including a cam wheel operating in timed relationship to the forward and rearward movement of said pusher means, control lever means operated by said cam wheel and operatively connected to said pusher means, an operator shaft extending transversely of said treatment chamber and supporting said pusher means thereon, said control lever means including a first cam lever fixed at one end to said operator shaft and having a free end spaced from said operator shaft, and a second cam lever pivotally supported at one end and having a medial portion engaged by said cam wheel to raise and lower the opposite end of said second cam lever, the free end of said first cam lever being operatively connected to said other end of said second cam lever so that said operator shaft is rocked at the end of each forward and rearward movement of said pusher means supported thereby.

7. In an apparatus for the continuous crushing of cloth, such as velvet or other pile type fabric, by the formation of random creases including an elongated treatment chamber having an entrance defining an entrance opening and in which treatment chamber the crushed cloth accumulates, guide plate means extending outwardly from the bottom of said entrance opening of said treatment chamber for directing the cloth into said treatment chamber, a plurality of pusher feet supported for forward and rearward movement along said guide plate means and extending transversely and in spaced-apart relationship adjacent the entrance end of said treatment chamber, said pusher feet being engageable with the cloth for moving the cloth along said guide plate means to successively stuff the cloth through said treatment chamber with each forward movement thereof, the combination therewith of gate means supported on the entrance end of said treatment chamber and extending partially across said entrance opening for permitting stuffing of the cloth into said treatment chamber while aiding in preventing withdrawal of the cloth from said treatment chamber upon rearward movement of said pusher feet, said gate means comprising individual spaced-apart finger elements including forward ends fixed to the top of said entrance opening and extending downwardly therefrom to form an upwardly diverging area adjacent the upper portion of said entrance opening, said finger elements being spaced above said guide plate means and including curved medial portions positioned between each of said pusher feet and free rearward ends.

* * * * *